United States Patent [19]

Kusayama

[11] 4,441,235

[45] Apr. 10, 1984

[54] SLIDE FASTENER WITH BOTTOM STOP

[75] Inventor: Masahiro Kusayama, Kurobe, Japan

[73] Assignee: Yoshida Kogyo K. K., Tokyo, Japan

[21] Appl. No.: 227,469

[22] Filed: Jan. 22, 1981

[30] Foreign Application Priority Data

Feb. 1, 1980 [JP] Japan ..... 55-11182[U]

[51] Int. Cl.[3] ..... A44B 19/36

[52] U.S. Cl. ..... 24/433; 24/410

[58] Field of Search ..... 24/205.11 F, 205.13 R, 24/205.11 R, 205.11 L, 205.14 R

[56] References Cited

U.S. PATENT DOCUMENTS

| | | | |
|---|---|---|---|
| 3,104,438 | 9/1963 | Scarpini | 24/205.11 |
| 4,104,767 | 8/1978 | Warran | 24/205.11 R |
| 4,152,813 | 5/1979 | Heimberger | 24/205.11 F |
| 4,270,248 | 6/1981 | Akashi | 24/205.11 R |

*Primary Examiner*—Gene Mancene
*Assistant Examiner*—John G. Weiss
*Attorney, Agent, or Firm*—Hill, Van Santen, Steadman & Simpson

[57] ABSTRACT

A slide fastener bottom end stop comprises three members combinable into a functionally integral body upon being threaded through a slider. A first member which is mounted on a first bead and substantially identical in shape and size with a fastener element engages a lowermost element on a second bead. A second member which is mounted on the first bead a given distance below the first member has protuberances extending obliquely upwardly towards the second bead. A third member which is mounted on the second bead one interelement distance below the lowermost element has tongues extending obliquely downwardly towards the first bead for smooth engagement with the protuberances of the second member.

1 Claim, 13 Drawing Figures

SLIDE FASTENER WITH BOTTOM STOP

BACKGROUND OF THE INVENTION

1. Field of the Invention

The present invention relates generally to slide fasteners, and more particularly to a bottom end stop for slide fasteners which comprises a plurality of separate members combinable into a functionally integral body upon being threaded through a slider.

2. Prior Art

A typical example of end stop of the type described is disclosed in U.S. Pat. No. 3,104,438. The disclosed device comprises three members, one of which has its width slightly greater than the distance between the diamond and the side flanges of the slider. This widened member is forced into the slider between the diamond and the side flanges thereof to join with the other members to provide a unitary bottom stop and thereafter is ready for abutting engagement with the diamond to restrict the downward movement of the slider. This prior device has suffered two deficiencies. Firstly, due to forced passage of the widened member through the slider, the widened member, the diamond and/or the side flange of the slider are prone to become worn or otherwise damaged by frictional engagement with each other to render the bottom stop inoperative. Secondly, the constituent members of the bottom end stop once united were liable to be displaced or disengaged under the influence of severe stresses exerted laterally of the slide fastener or perpendicularly to the slide fastener plane.

SUMMARY OF THE INVENTION

It is an object of the present invention to provide a slide fastener having a bottom end stop comprising separate members which will remain interlocked under forces tending to displace these members from each other either perpendicularly to the slide fastener plane or laterally of the slide fastener.

It is another object of this invention to provide a slide fastener having a bottom stop comprising three normally separate members which can smoothly enter a slider whereupon they can be held unitarily together to lock the slider.

It is still another object of this invention to provide a slide fastener having a bottom end stop comprising three components which can readily engage each other to form a unified body serving to lock the slider in the well known manner.

It is still another object of this invention to provide a slide fastener having a bottom end stop which will permit smooth reciprocation of the slider all the way between the opposite endmost fastener elements.

It is yet another object of this invention to provide a slide fastener having a bottom end stop which can be mounted the stringer tape simultaneously and in the same stage of manufacture as the fastener elements are mounted.

It is yet another object of this invention to provide a slide fastener having a bottom end stop which is capable of passing through a slider subsequently to mounting of the bottom stop upon stringers, thereby permitting sewing of the stringers without interference of sliders (to produce what is called "a semi-finished product slide fastener without a slider") onto an article.

The above objects are attained according to the present invention by providing a bottom end stop on a slide fastener, said bottom stop including a first member mounted on a first bead for engagement with the lowermost coupling element mounted on a second bead, the first member including a base and a coupling head substantially identical in shape and size with the base and the coupling head, respectively, of the fastener element and having a bay at the lower part of the base, a second member mounted on the first bead a given distance below the first member, the second member being substantially of a C-shaped configuration and including a base for the mounting, upper and lower protuberances protruding obliquely upwardly towards the second bead from the upper and lower ends, respectively, of the base with a recess defined therebetween, a third member mounted on the second bead and disposed in opposed relation to the second member and one interelement distance below the lowermost coupling element, thus leaving intact a portion of the bead having a length substantially corresponding to one interelement distance, the third member having a substantially inverted F-shaped configuration and including a support obliquely mounted on the second bead, upper and lower tongues projecting obliquely downwardly from the upper end and the middle, respectively, of the support, defining, between both the tongues and between the lower tongue and the support, upper and lower cavities, respectively, the maximum width of the third member being slightly shorter than the distance between the diamond and flange of the slider, the third member having formed at the apex of the support thereof a concavity for engagement with the coupling head of the first member, the upper and lower cavities and the lower tongue of the third member being engageable with the upper and lower protuberances and the recess, respectively, of the second member.

Other objects and many of the attendant advantages of this invention will be readily appreciated as the same becomes better understood by reference to the following detailed descritpion when considered in connection with the accompanying drawings, in which like reference characters designate the same or similar parts throughout the figures thereof.

DETAILED DESCRIPTION OF THE PREFERRED EMBODIMENTS

Figure 1:
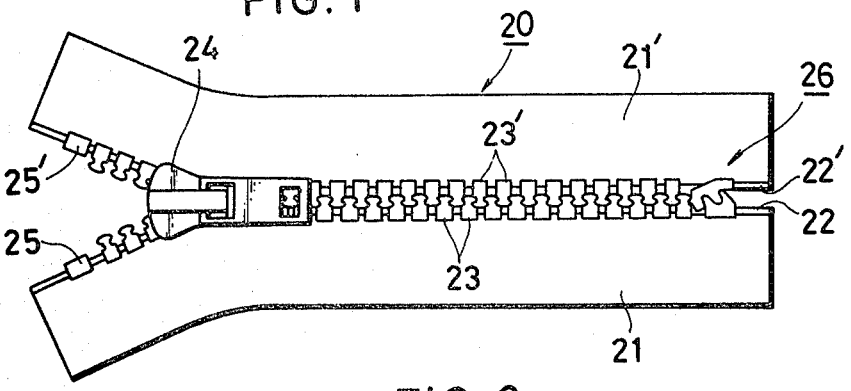
FIG. 1 is a front elevational view of a slide fastener incorporating a bottom stop according to the present invention.

As illustrated in FIG. 1, a slide fastener 20 comprises a pair of stringer tapes 21, 21' having a pair of first and second beads 22, 22' attached to their respective inner longitudinal edges, and a pair of rows of interlocking fastener elements 23, 23' mounted on and along the beads 22, 22', respectively. A slider 24 is mounted on and slidable along the rows of fastener elements 23, 23' for taking the elements 23, 23' into and out of interdigitating engagement with each other to open and close the slide fastener 20. A pair of top stop members 25, 25' is mounted on the beads 22, 22', respectively, at the top of the rows of coupling elements 23, 23' to prevent the slider 24 from running off the element rows past the top stop members 25, 25'. Similarly, at the bottom of the element rows 23, 23', a novel bottom stop 26 is mounted to prevent the slider 24 from running off the element rows past the bottom stop 26, which is described further in detail hereinafter. The term "fastener stringer" used herein means a separate slide fastener half devoid of a slider.

Figure 2:
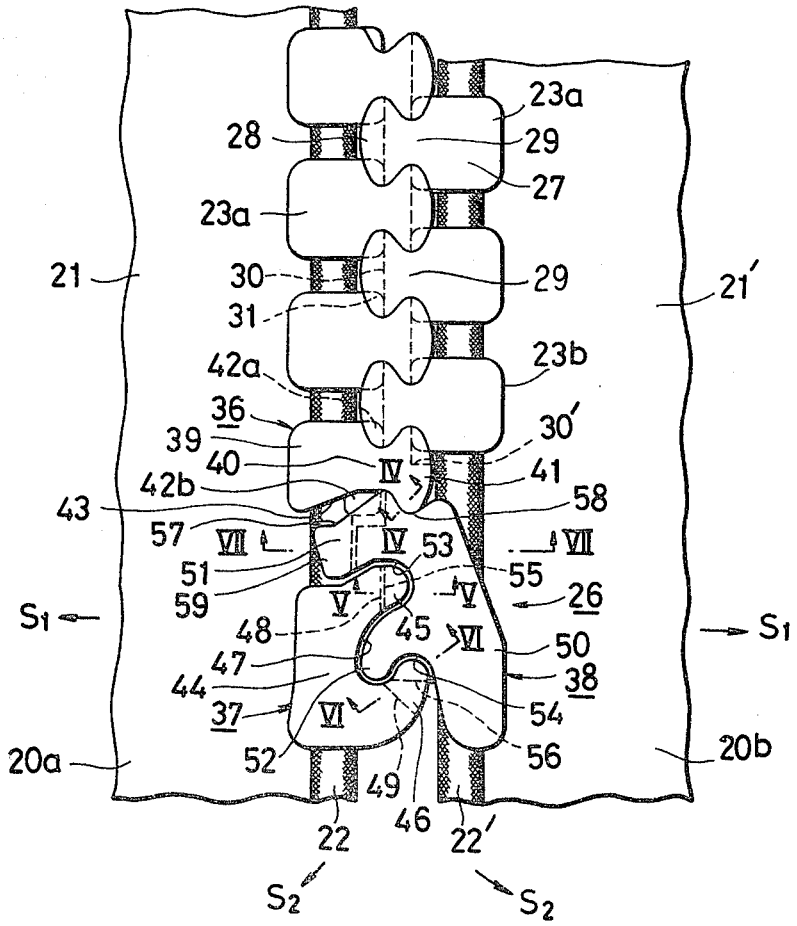
FIG. 2 is an enlarged front elevational view of the bottom stop shown in FIG. 1.
Figure 3:
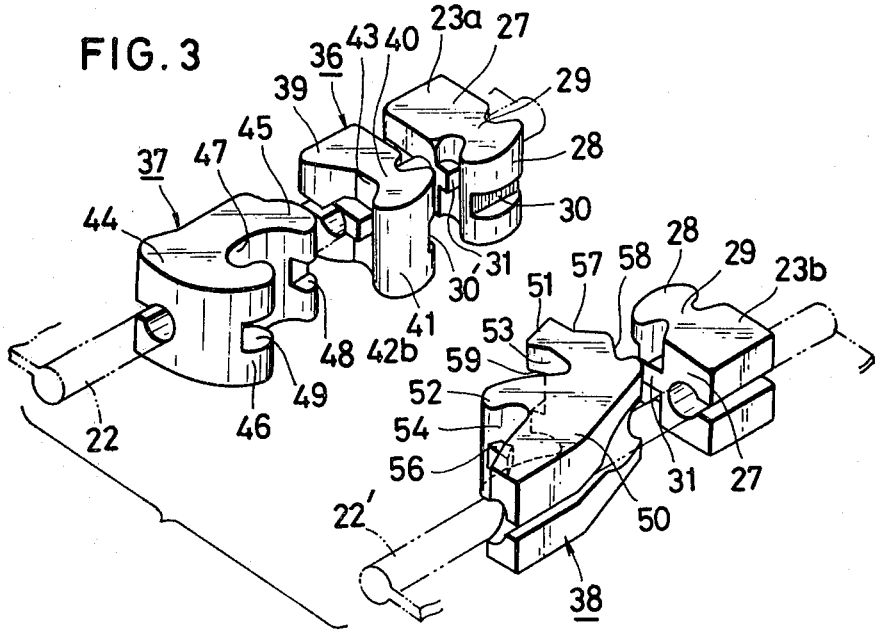
FIG. 3 is an enlarged perspective view of the bottom stop of FIG. 2 as it is separated into constituent members.

As clearly shown in FIGS. 2 and 3, each fastener element 23*a* comprises a base or leg portion 27 anchored in place on the bead 22, 22', a coupling head 28 extending forwardly therefrom and a reduced neck portion 29 interposed between the base 27 and the coupling head 28. The base 27 and the coupling head 28 are substantially rectangular and elliptical, respectively, in shape as seen perpendicularly to the plane of the slide fastener 20. At the front part of the coupling head 28, there is a groove 30 extending in parallel relation to the beads 22, 22'. Integral with both the shoulders or front edges of the base 27, a pair of coupling fins 31 extend forwardly therefrom for engagement with the grooves 30 of the two adjacent mating elements 23*a* carried on the opposed fastener tape, as shown in FIG. 2.

As shown in FIGS. 8 through 11, the slider 24 comprises a slider body 32, a diamond or a wedge-shaped neck portion 33 disposed centrally at a flared front end thereof and a pair of first and second flanges 34, 34' disproved along both the sides, respectively, of the slider body 32 to define with the diamond 33 a Y-shaped channel 35 for passage of the bottom stop as well as the fastener element rows 23, 23'.

As shown in FIGS. 2 and 3, the bottom stop 26 comprises a first member 36 mounted on the first bead 22 for engagement with the lowermost fastener element 23*b* mounted on the second bead 22', a second member 37 mounted on the first bead 22 and disposed a given distance below the first member 36, and a third member 38 mounted on the second bead 22' and disposed substantially an interelement distance below the lowermost element 23*b* and in opposed relation to the second member 37. The term "an interelement distance" used here is defined as a distance between the lower extremity of each element and the upper extremity of the next lower element. The first member 36 comprises a base or leg portion 39, a neck portion 40, a coupling head 41 and an upper coupling fin 42*a* substantially identical in shape and size with the base 27, the neck portion 29, the coupling head 28 and the coupling fins 31, respectively, of each coupling element 23*a* except that the lower part of the base 39 has a bay 43, that a lower fin 42*b* is slightly larger than the upper fin 42*a*, and that a groove 30' terminates at the midpoint of the coupling head 41. The second member 37 is substantially of a C-shaped configuration and comprises a base 44 anchored on the first bead 22, upper and lower protuberances 45, 46 protruding obliquely upwardly, as viewed in FIG. 2, towards the second bead 22' from the upper and the lower end, respectively, of the base 44, with a recess 47 defined therebetween. The lower protuberance 46 has an arcuate lower surface. The upper and lower protuberances 45, 46 of the second member 37 have at their free ends upper and lower grooves 48, 49, respectively, which extend parallel to the first bead 22. The third member 38 has a substantially inverted or reversed F-shaped configuration and comprises a support 50 mounted on the second bead 22' in oblique relation thereto, a pair of upper and lower tongues 51, 52 projecting obliquely downwardly from the upper end and the middle, respectively, of the support 50, defining between both the tongues 51, 52 and between the lower tongue 52 and the support 50, a pair of arcuate upper and lower cavities 53, 54. The third member 38 in the upper and lower cavities 53, 54 thereof has a pair of upper and lower tenons 55, 56. The upper tongue 51 of the third member 38 is bifurcated at its free end 59 and recessed at its upper surface to provide an abutment 57 for engagement with the diamond 33 of the slider 24. Behind the bifurcated end or on the apex of the support 50 there is a concavity 58 for engagement with the lower part of the coupling head 41 of the first member 36. The third member 38 has an edge having a first planar portion parallel to the bead, and at this portion, the third member 38 has an effective width exceeding the distance between the diamond 33 and the second flange 34'. The edge of the third member 38 has a second planar portion disposed at an angle with respect to the bead, and at this portion, the maximum width of the third member 38 is slightly less than the distance between the diamond 33 and the second flange 34' of the slider 24.

Figure 4:
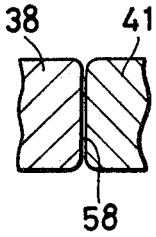
FIGS. 4, 5, 6 and 7 are cross-sectional views taken along lines IV—IV, V—V, VI—VI and VII—VII, respectively of FIG. 2.
Figure 5:
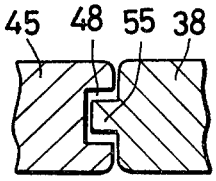
Figure 6:
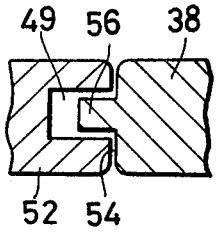
Figure 7:
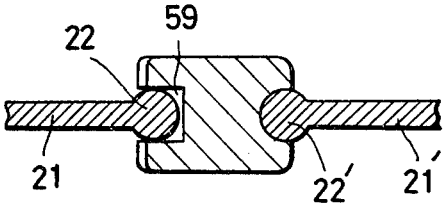
Figure 8:
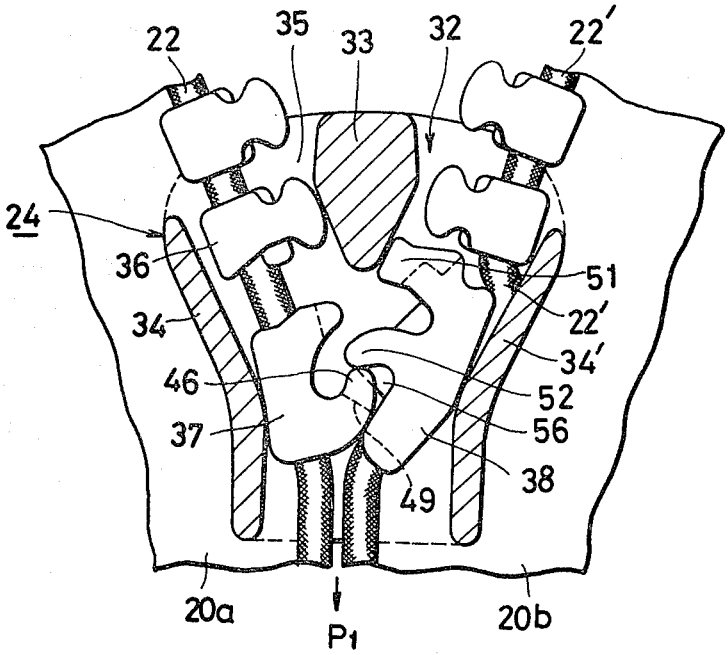
FIGS. 8, 9, 10 and 11 are front elevational views showing sequential phases of bringing the bottom stop members into interlocking engagement with each other.
Figure 9:
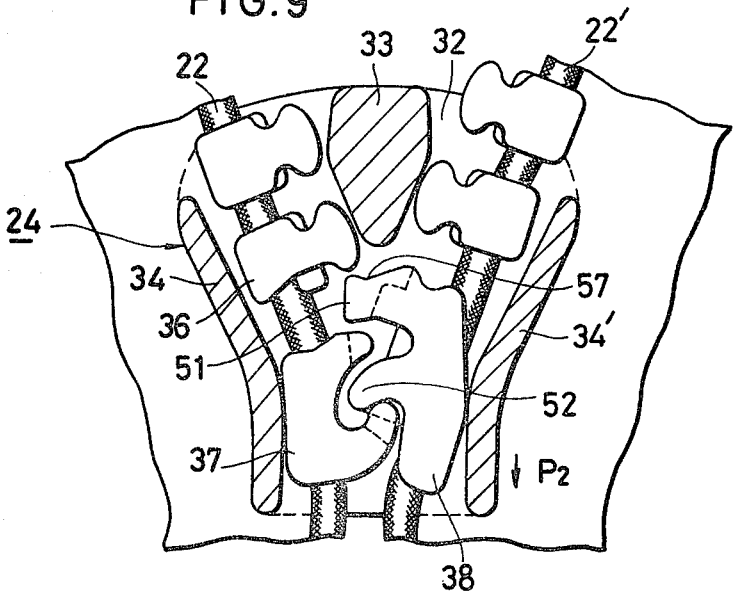
Figure 10:
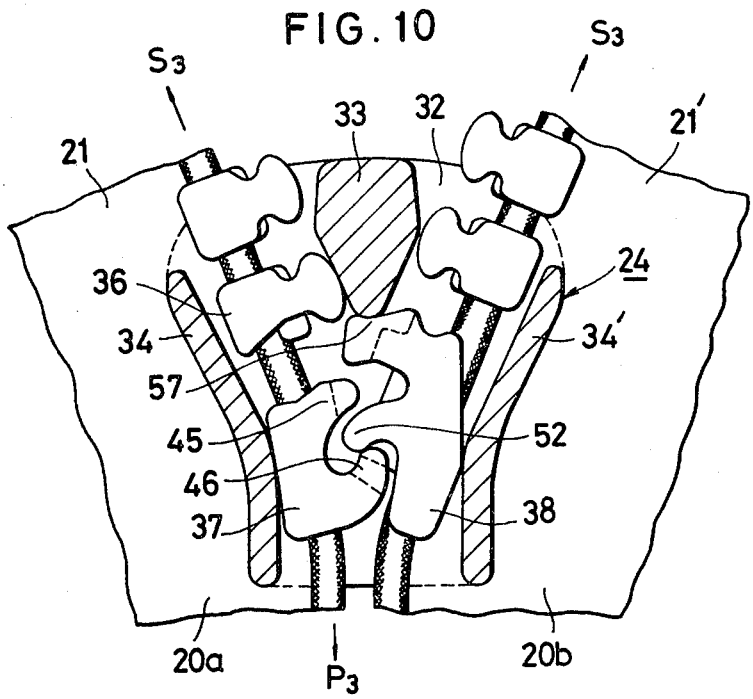
Figure 11:
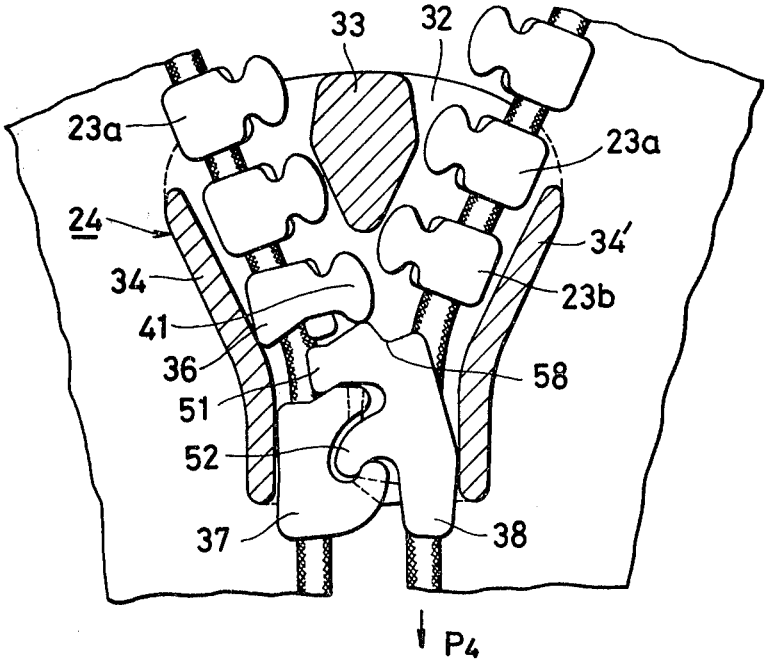

The bottom stop members 36, 37, 38 are assembled together as follows: The fastener stringers 20*a*, 20*b* are inserted through the slider 24 from the flared upper end thereof as shown in FIG. 8. At this phase, the lower tongue 52 of the third member 38 partly engages the lower protuberance 46 of the second member 37 with the lower tenon 56 of the third member 38 partly engaged in the lower groove 49 of the second member 37. The third member 38, upon passage between the diamond 33 and the second flange 34' of the slider 24, is allowed to tilt outwardly relative to the diamond 33 due to resiliency of that portion of the second bead 22' lying immediately above the third member 38. Since the maximum width of the third member 38 is slightly less than the distance between the diamond 33 and the second flange 34' of the slider 24, the third member 38 can be smoothly inserted into the slider 24. A slight pull on the stringers 20*a*,20*b* exerted in the direction indicated by an arrow P1 of FIG. 8 causes the second and third members 37, 38 to descend along the first and second inwardly curved flanges 34, 34', respectively, and to tilt inwardly towards each other within the slider 24. The upper tongue 51 of the third member 38 is thus moved immediately below the diamond 33 as shown in FIG. 9. When the slider is slightly pulled in the direction of an arrow P2, the lower tip of the diamond 33 is brought into abutting engagement with the abutment 57 of the third member 38, as shown in FIG. 10. This engagement prevents further downward movement of the slider 24. At this phase, the downwardly slanting lower tongue 52 of the third member 38 firmly engages the upwardly slanting lower protuberance 46 of the second member 37, so that each of the fastener stringers 20*a*, 20*b* is prevented from detachment from the other stringer 20*b*, 20*a* and from separation from the slider 24 even under severe stresses applied thereto in the direction of an arrow S3 on FIG. 10. A further pull of the fastener stringers 20*a*, 20*b* in the direction of an arrow P3 with respect to the slider brings the second and third members 37, 38 into substantially complete locking engagement with each other and at the same time brings the first and third members 36, 38 into partial engagement with each other, as shown in FIG. 11, whereupon the coupling head 41 of the first member 36 starts sliding along the concavity 58 of the third member 38 for interfitting engagement therewith. Partly because the first member 36 is substantially identical in shape and size with a fastener element 23*a*, and partly because both the engagements between the first and third members 36, 38, and between the first member 36 and the lowermost element 23*b* are substantially identical in manner with that between every two adjacent fastener elements 23*a*, unobstructed or smooth reciprocation of the slider 24 is assured all the way between the third member 38 of the bottom stop 26 and the top stop members 25, 25'. When the fastener stringers 20*a*, 20*b* are further pulled in the direction an arrow P4, both the bottom stop members 36, 37, 38 and some adjacent fastener elements 23*a*, 23*b* are brought into coupling disposition, as shown in FIG. 2. In this coupling disposition, the upper and lower protuberances 45, 46 of the second member 27 engage the upper and lower tongues 51, 52, respectively, of the third member 38, and as better shown in FIGS. 5 and 6, the upper and lower tenons 55, 56 of the third members 38 engage in the upper and lower grooves 48, 49, respectively, of the second member 37. As shown in FIGS. 2 and 7, the bifurcated end 59 of the upper tongue 51 of the third member 38 is disposed astride of the first bead 22 and of the lower coupling fin 42*b* of the first member 36. Furthermore, as better shown in FIGS. 2 and 4, the coupling head 41 of the first member 36 engages at its upper part with the reduced neck portion 29 of the lowermost fastener element 23*b* and at its lower part with the concavity 58 of the third member 38.

From the construction and the operation of the bottom stop 26, many advantages result. The bottom stop 26, when assembled, is prevented from being accidentally broken apart because of firm and stable interengagement between the upper and lower protuberances 45, 46 of the second member 37 and the upper and lower tongues 51, 52, respectively, of the third member 38, even under severe lateral forces tending to pull apart the stringers 20*a*, 20*b* from each other either in the direction indicated by an arrow S1 or in the direction indicated by an arrow S2 of FIG. 2. Unobstructed and smooth reciprocation of the slider 24 is ensured all the way between the third member 38 of the bottom stop 26 and the top stop members 25, 25'. That portion of the second bead 22' lying between the lowermost element 23*b* and the third member 38, being substantially as short as one interelement distance, is resistant enough to severe stresses exerted perpendicularly to the slide fastener plane or laterally of the slide fastener to prevent the bottom stop members 36, 37, 38 from accidental disassemblage. Since the upper and lower protuberances 45, 46 of the second member 37 extend obliquely upwardly towards the second bead 22', and the upper and lower tongues 51, 52 of the third member 38 extend obliquely downwardly towards the first bead 22, the upper and lower protuberances 45, 46 of the second member 37 and the upper and lower tongues 51, 52 of the third member 38 are engageable together smoothly without any clumsiness.

Figure 12:
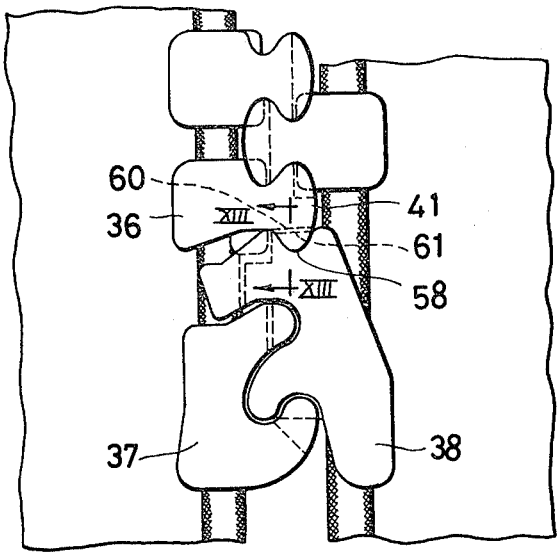
FIG. 12 is a view similar to FIG. 2 showing a bottom stop according to another embodiment of the invention.
Figure 13:
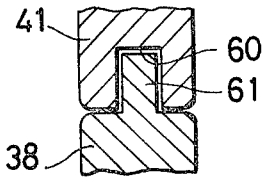
FIG. 13 is a cross-sectional view taken along line XIII—XIII of FIG. 12.

FIGS. 12 and 13 show a modification of the present invention wherein the first member 36 has a slot 60 formed in the lower part of the coupling head 41 thereof so as to extend in the slide fastener plane, and the third member has a crest 61 provided in the concavity 58 so as to extend also in the slide fastener plane for engagement in the slot 60. Terms such as "upper", "lower", "front", "top", "bottom" and the like are used herein as terms of reference and not of limitation. Thus with the slide fastener incorporated vertically into the front of a garment, the bottom stop structure would be lowermost.

Obviously, many modifications and variations of the present invention are possible in the light of the above teachings. It is therefore to be understood that within the scope of the appended claim, the invention may be practiced or otherwise than as specifically described.

What is claimed is:

1. A slide fastener, comprising:

(a) a pair of stringers having interlocking fastener elements carried on marginal beads thereof;

(b) a slider cooperable with said fastener elements to interlock and to disengage them in response to opposite directions of movement along said pair of stringers, said slider having a diamond disposed between a pair of flaring flanges; and (c) a 3-piece bottom end stop including (1) a first member mounted on a first of said beads and engageable with the lowermost fastener element on a second of said beads, (2) a second member mounted on said first bead in spaced relation to said first member, and having spaced upper and lower protruberances extending obliquely upwardly towards said second bead, and (3) a third member mounted on said second bead opposite to said second member, and having upper and lower tongues extending obliquely downwardly towards said first bead, said upper tongue being fixedly trapped between said first member and said upper protruberence and said lower tongue being fixedly trapped between said upper and lower protruberence, and said third member having a longitudinal edge facing that one of said slider flanges associated with said second bead, said edge having a first planar portion parallel to said second bead, said third member having an effective width taken at said first planar portion exceeding the distance between said diamond and said one slider flange, said edge having a second planar portion disposed at an angle with respect to said second bead, said third member having a width at said second planar portion less than said distance, whereby said third member can be inserted into said slider only by first temporarliy distorting said second bead adjacent to said third member, whereupon after insertion said third member is movable to its normal non-bead-distorted position to place an end thereof into blocking position with respect to said diamond.

* * * * *